US008667795B2

(12) United States Patent
Steiner et al.

(10) Patent No.: US 8,667,795 B2
(45) Date of Patent: Mar. 11, 2014

(54) INTERNAL COMBUSTION ENGINE WITH EXHAUST-GAS TURBOCHARGING

(75) Inventors: Bernd Steiner, Bergisch Gladbach (DE); Kai Sabastian Kuhlbach, Bergisch Gladbach (DE)

(73) Assignee: Ford Global Technologies, LLC, Dearborn, MI (US)

( * ) Notice: Subject to any disclaimer, the term of this patent is extended or adjusted under 35 U.S.C. 154(b) by 581 days.

(21) Appl. No.: 12/687,226

(22) Filed: Jan. 14, 2010

(65) Prior Publication Data

US 2010/0175374 A1 Jul. 15, 2010

(30) Foreign Application Priority Data

Jan. 14, 2009 (DE) ..... 10 2009 000 214

(51) Int. Cl.

| | |
|---|---|
| ***F02M 25/06*** | (2006.01) |
| ***F01N 5/04*** | (2006.01) |
| ***F02B 33/44*** | (2006.01) |
| ***F02B 47/08*** | (2006.01) |
| ***F02F 1/10*** | (2006.01) |
| ***F02M 25/07*** | (2006.01) |

(52) U.S. Cl.

USPC ..... 60/605.1; 60/278; 60/280; 60/598; 60/605.2; 123/41.72; 123/568.11

(58) Field of Classification Search

USPC ..... 60/278, 280, 598, 605.1, 605.2, 605.3; 123/41.72, 559.1, 568.11, 568.13

See application file for complete search history.

(56) References Cited

U.S. PATENT DOCUMENTS

| | | | | |
|---|---|---|---|---|
| 6,213,088 | B1 * | 4/2001 | Ottowitz | 123/299 |
| 6,446,592 | B1 * | 9/2002 | Wilksch | 123/196 R |
| 7,806,110 | B1 * | 10/2010 | Broman et al. | 123/559.1 |
| 2009/0126659 | A1 * | 5/2009 | Lester et al. | 123/41.72 |

FOREIGN PATENT DOCUMENTS

| | | | |
|---|---|---|---|
| JP | 2002303145 | A * | 10/2002 |
| JP | 2006249945 | A * | 9/2006 |
| WO | WO 2007105108 | A2 * | 9/2007 |
| WO | WO 2008008379 | A2 * | 1/2008 |
| WO | 2008102917 | A1 | 8/2008 |

OTHER PUBLICATIONS

Partial Translation of Office Action of Chinese Application No. 201010003171.1, Issued Mar. 13, 2013, State Intellectual Property Office of PRC, 7 Pages.

* cited by examiner

*Primary Examiner* — Kenneth Bomberg
*Assistant Examiner* — Audrey K Bradley
(74) *Attorney, Agent, or Firm* — Julia Voutyras; Alleman Hall McCoy Russell & Tuttle LLP

(57) ABSTRACT

Disclosed is a turbocharged internal combustion engine having at least one intake for supplying the internal combustion engine with fresh air or fresh mixture on an inlet side, a cylinder head having at least two cylinders which are arranged along a cylinder head longitudinal axis and each of which has at least one outlet opening which is adjoined by an exhaust line for discharging the exhaust gases out of the cylinder, the exhaust lines of at least two cylinders being merged on an outlet side, so as to form an integrated exhaust manifold within the cylinder head, to form an overall exhaust line. Also disclosed is at least one exhaust-gas turbocharger which comprises a turbine arranged in the overall exhaust line and a compressor arranged in the at least one intake.

17 Claims, 2 Drawing Sheets

INTERNAL COMBUSTION ENGINE WITH EXHAUST-GAS TURBOCHARGING

BACKGROUND AND SUMMARY

The present disclosure relates to a turbochaged internal combustion engine having at least one intake for supplying the internal combustion engine with fresh air or fresh mixture on an inlet side, a cylinder head having at least two cylinders which are arranged along a cylinder head longitudinal axis and each of which has at least one outlet opening which is adjoined by an exhaust line for discharging the exhaust gases out of the cylinder, with the exhaust lines of at least two cylinders being merged on an outlet side, so as to form an integrated exhaust manifold within the cylinder head, to form an overall exhaust line, and at least one exhaust-gas turbocharger which comprises a turbine arranged in the overall exhaust line and a compressor arranged in the at least one intake, with the turbine having a turbine rotor, which is provided on a charger shaft, and an inlet region for supplying the exhaust gas, and the compressor having a compressor rotor, which is arranged on the charger shaft, and an outlet region for discharging the compressed combustion air.

Within the context of the present disclosure, the expression "internal combustion engine" encompasses in particular diesel engines but also spark-ignition engines and hybrid internal combustion engines. The arrangement of the at least two cylinders along the cylinder head longitudinal axis does not restrict the internal combustion engine according to the invention to in-line engines. In fact, a two-cylinder V engine, for example, is also an internal combustion engine having at least two cylinders arranged along a cylinder head longitudinal axis.

For engine pressure charging, use is often made of an exhaust-gas turbocharger. The advantages of the exhaust-gas turbocharger, for example in comparison with a mechanical charger, lie in the fact that no mechanical connection is required for transmitting power between the charger and the internal combustion engine. While a mechanical charger extracts the energy required for driving it entirely from the internal combustion engine, and therefore reduces the provided power and in this way reduces efficiency, the exhaust-gas turbocharger utilizes the exhaust-gas energy of the hot exhaust gases.

In an exhaust-gas turbocharger, a compressor and a turbine are arranged on the same shaft, which is also referred to below as a charger shaft, wherein the hot exhaust-gas flow is supplied to the turbine and is expanded in said turbine so as to release energy, as a result of which the charger shaft is set in rotation. The energy discharged from the exhaust-gas flow to the turbine and ultimately to the charger shaft is utilized to drive the compressor which is likewise arranged on the charger shaft. The compressor delivers and compresses the charge air supplied to it, thereby turbocharging the cylinders.

Turbocharging serves primarily to increase the power of the internal combustion engine. Here, the air required for the combustion process is compressed, as a result of which a greater air mass can be supplied to each cylinder per working cycle. In this way, the fuel mass and therefore the mean effective pressure $p_{me}$ can be increased.

Turbocharging is therefore a suitable means for increasing the power of an internal combustion engine for an unchanged swept volume or reducing the swept volume for an unchanged level of power. In any case, turbocharging leads to an increase in volumetric power output and to a more favorable power-to-weight ratio. For the same vehicle boundary conditions, it is thus possible for the load collective to be shifted toward higher loads, where the specific fuel consumption is lower. This is also referred to as downsizing.

Tubrocharging consequently assists the continuing efforts in the development of internal combustion engines to minimize fuel consumption and therefore improve the efficiency of the internal combustion engine.

It is a further fundamental aim to reduce pollutant emissions. Turbocharging the internal combustion engine can likewise be expedient in solving this problem. With targeted design of the turbocharging, it is specifically possible to obtain advantages in efficiency and in exhaust-gas emissions. It is thus possible by means of suitable turbocharging, for example in a diesel engine, to reduce nitrogen oxide emissions without any loss in efficiency. At the same time, hydrocarbon emissions can be positively influenced. The emissions of carbon dioxide, which correlate directly with fuel consumption, likewise decrease with falling fuel consumption.

Turbocharging is therefore likewise suitable for reducing pollutant emissions.

Further aims in the development of turbocharged internal combustion engines are improving the response behavior in dynamic operation of the internal combustion engine, and improving the torque characteristic in the lower rotational speed range.

Specifically, according to the prior art, a noticeable torque drop is observed in the event of a certain rotational speed being undershot. This effect is undesirable and is one of the most severe disadvantages of exhaust-gas turbocharging.

Said torque drop is understandable if one takes into consideration that the charge pressure ratio is dependent on the turbine pressure ratio. If, for example in a diesel engine, the engine speed is reduced, this leads to a lower exhaust-gas mass flow and therefore to a lower turbine pressure ratio. This has the result that, toward lower rotational speeds, the charge pressure ratio likewise decreases, which is equivalent to a torque drop.

Here, it is fundamentally possible for the drop in charge pressure to be counteracted by reducing the size of the turbine cross section, and the associated increase in the turbine pressure ratio, though this leads to disadvantages at high rotational speeds.

In practice, the described relationships often lead to a plurality of turbochargers or combinations of exhaust-gas turbocharging with mechanical turbocharging being used in order to improve the torque characteristic.

The present disclosure describes an internal combustion engine which has at least one exhaust-gas turbocharger, with it also being possible for two or three exhaust-gas turbochargers to be provided.

To improve response behavior, the line volume of the exhaust lines from the cylinders to the turbine should be as small as possible, for which reason it is fundamentally sought to arrange the turbine of the exhaust-gas turbocharger as close to the outlet of the internal combustion engine as possible, also in order to be able to optimally utilize the exhaust-gas enthalpy of the hot exhaust gases in this way under all operating states of the internal combustion engine. The exhaust gases should cool down as little as possible before reaching the inlet into the turbine.

In conjunction with the latter, it is considered to be expedient to minimize the thermal inertia of the part of the exhaust lines situated between the cylinders and the turbine, which may be achieved by reducing the mass and the length of said part.

For the above-stated reasons, in the internal combustion engine according to the disclosure, the exhaust lines of at least two cylinders, which exhaust lines adjoin the outlet openings, are merged within the cylinder head, so as to form an integrated exhaust manifold, to form an overall exhaust line. The length of the exhaust lines is reduced by its integration into the cylinder head. This firstly reduces the line volume, that is to say the exhaust-gas volume, of the exhaust lines upstream of the turbine, such that the response behavior of the turbine is improved. Secondly, the shortened exhaust lines also lead to a reduced thermal inertia of the exhaust system upstream of the turbine, such that the temperature of the exhaust gases at the turbine inlet is increased, as a result of which the enthalpy of the exhaust gases is also higher at the inlet of the turbine. Said measure also reduces the vehicle weight and enables more effective packaging in the engine bay.

If the cylinders have more than one outlet opening, the exhaust lines of the individual cylinders are preferably merged to form a partial exhaust line associated with the cylinder, before the partial exhaust lines of at least two cylinders are merged to form an overall exhaust line, in order to thereby further shorten the overall path of all the exhaust lines.

Downstream of the at least one integrated manifold, the exhaust gases are then supplied to the turbine of at least one exhaust-gas turbocharger and if appropriate one or more exhaust-gas aftertreatment systems. As a result of the short path to the different exhaust-gas aftertreatment systems, the exhaust gases have less time available to cool down, and the exhaust-gas aftertreatment systems reach their operating temperature or light-off temperature more quickly, in particular after a cold start of the internal combustion engine.

To be able to utilize the exhaust-gas energy, which is defined substantially by the exhaust-gas temperature and the exhaust-gas pressure, as efficiently as possible, the exhaust gas or the exhaust-gas flows should not only be at the highest possible temperature, but rather also should not be frequently deflected, that is to say should be subjected to as few changes in direction as possible before reaching the inlet into the turbine rotor. Any change in direction of the exhaust-gas flow—for example as a result of a curvature of the exhaust line—results in a pressure loss in the exhaust-gas flow, and therefore an energy loss.

For the same reason, anything which results in the pressure in the exhaust gas being reduced and the exhaust-gas energy available to the turbine being reduced should also be avoided. For example, no further assemblies, in particular no exhaust-gas aftertreatment system, should be provided upstream of the turbine. An exhaust-gas aftertreatment system provided upstream of the turbine would act as a throttle element and would reduce the pressure in the exhaust gas.

That which has been stated in conjunction with the turbine with regard to the response behavior and the pressure loss also applies analogously to the compressor on the inlet side of the internal combustion engine. The response behavior of the exhaust-gas turbocharging and therefore the dynamic operating behavior of the internal combustion engine deteriorate with increasing line length.

Assemblies arranged downstream of the compressor in the intake reduce the charge pressure generated in the compressor and therefore the mass and the pressure of the combustion air supplied to the cylinders during a charge exchange. A charge-air cooler and, if appropriate, a throttle element are nevertheless often also provided downstream of the compressor, with the charge-air cooler increasing the density of the combustion air and therefore contributing to a better charge of the combustion chambers.

To keep the pressure loss in the flow low, any changes in direction to which the combustion air which is compressed in the compressor is subjected on the path to the cylinders should be as slight as possible, for which reason the intake downstream of the compressor should have as few curves as possible.

The latter in particular cannot be realized in a satisfactory manner in practice when using an exhaust-gas turbocharger. To meet the demands with regard to the arrangement of the turbine, an exhaust-gas turbocharger according to the prior art is arranged on the exhaust-gas side, such that the turbine is situated as close as possible to the outlet of the internal combustion engine, or as close as possible to the exhaust manifold. Although said approach ensures a high exhaust-gas enthalpy at the inlet into the turbine with the advantages specified above, it results in the intake being lengthened considerably. The intake, proceeding from the compressor, extends from the exhaust-gas side to the other side of the cylinder head to the intake side and into the inlet region of the internal combustion engine, wherein it is often necessary for said intake to be guided around other lines and assemblies arranged on the internal combustion engine, but in particular around the cylinder head.

As a result, the intake downstream of the compressor has not only an undesirably long length, and therefore an undesirably high line volume, but rather also numerous curves which deflect the compressed combustion air. The result of this approach is a noticeable pressure drop in the combustion air.

The above statements make it clear that there is a conflict of aims between firstly the arrangement of the turbine and secondly the arrangement of the compressor. This is because, if the compressor were arranged in an optimum manner corresponding to its demands, it would not be possible to maintain the position of the turbine on the exhaust-gas side close to the outlet of the internal combustion engine, and the position of the turbine would have to be relocated to the intake side.

A turbocharged internal combustion engine according to the present disclosure is presented, wherein the problems known from the prior art are overcome, and in particular allowance is made for the demands of the turbine and the demands of the compressor.

In particular, this disclosure describes a turbocharged internal combustion engine having at least one intake for supplying the internal combustion engine with fresh air or fresh mixture on an inlet side, a cylinder head having at least two cylinders which are arranged along a cylinder head longitudinal axis and each of which has at least one outlet opening which is adjoined by an exhaust line for discharging the exhaust gases out of the cylinder, with the exhaust lines of at least two cylinders being merged on an outlet side, so as to form an integrated exhaust manifold within the cylinder head, to form an overall exhaust line, and at least one exhaust-gas turbocharger which comprises a turbine arranged in the overall exhaust line and a compressor arranged in the at least one intake, with the turbine having a turbine rotor, which is provided on a charger shaft, and an inlet region for supplying the exhaust gas, and the compressor having a compressor rotor, which is arranged on the charger shaft, and an outlet region for discharging the compressed combustion air, which internal combustion engine is characterized in that the exhaust-gas turbocharger is arranged in such a way that the charger shaft runs transversely with respect to the cylinder head longitudinal axis, with the turbine being arranged on the outlet side and the compressor being arranged on the inlet side.

In such internal combustion engine, the charger shaft intersects a plane which runs through the cylinder head longitudinal axis, such that the turbine is situated on the outlet side of the cylinder head or of the internal combustion engine and the compressor is situated on the inlet side of the cylinder head or of the internal combustion engine.

Here, in simple terms, the "inlet side" and "outlet side" are separated by the cylinder head longitudinal axis, and are thus situated on different sides of the cylinder head longitudinal axis, with inter alia the inlet openings of the cylinders and the associated intakes being arranged on the inlet side, and with the outlet openings and the adjoining exhaust lines being arranged on the outlet side.

Both the compressor and the turbine are therefore situated on that side of the cylinder head or of the internal combustion engine which is relevant and advantageous with regard to their respective functions.

The conflict of aims between a functionally optimized arrangement of the turbine and a functionally optimized arrangement of the compressor which exists in the prior art can be resolved by the arrangement of the exhaust-gas turbocharger according to this disclosure.

It is thus possible in the internal combustion engine according to this disclosure for the compressor to be arranged close to the inlet region, and to simultaneously realize or maintain an arrangement of the turbine close to the outlet. It is thereby possible to realize both a short intake downstream of the compressor and also a short exhaust-gas discharge system, that is to say a short exhaust line system, upstream of the turbine, which results in the advantages already described further above.

The comparatively short lines lead to an improvement in the response behavior on both sides of the exhaust-gas turbocharger, with the exhaust gases which are supplied to the turbine having a small amount of time available to cool down.

In particular, the intake downstream of the compressor may not only be significantly shorter but rather may also be of considerably simpler geometrical design, that is to say with fewer curves, which noticeably reduces the drop in charge pressure as a result of flow deflections as flow passes through the intake.

The arrangement of the exhaust-gas turbocharger as described herein also permits dense packaging of the entire drive unit, also because it is no longer necessary for the intake to be conducted around the cylinder head from the exhaust-gas side to the inlet side.

The internal combustion engine according to the disclosure therefore solves the problem of providing a turbocharged internal combustion engine in which allowance is simultaneously made both for the demands of the turbine and also the demands of the compressor.

Embodiments of the internal combustion engine are advantageous in which the charger shaft runs perpendicularly with respect to the cylinder head longitudinal axis. Said arrangement of the charger or of the charger shaft enables the charger to be situated as close as possible to the cylinder head or cylinder block and thereby facilitates inter alia dense packaging in the engine bay, and also a significant shortening of the relevant lines on both sides of the internal combustion engine.

As shown schematically in FIG. 2, if appropriate, the charger 202 may be at least partially integrated in the cylinder head 204 or cylinder block 206 of the internal combustion engine 208, such that at least parts of the charger and of the cylinder head or cylinder block form a monolithic component, for which purpose a perpendicular profile of the charger shaft with respect to the cylinder head longitudinal axis is not imperative but is advantageous. Said design of the internal combustion engine has also proven to be particularly advantageous if the charger is supplied with coolant and/or oil via the cylinder head or cylinder block.

A perpendicular profile of the charger shaft with respect to the cylinder head longitudinal axis may also offer advantages with regard to the inflow conditions of the turbine and/or the flow conditions under which the combustion air leaves the compressor and is supplied to the inlet region, which will be discussed in more detail further below in conjunction with the different designs of turbine and compressor.

Embodiments of the internal combustion engine are advantageous in which the exhaust-gas turbocharger is arranged laterally on an end side of the cylinder head, wherein, within the context of the present invention, the end side refers to a side of the cylinder head which runs perpendicularly with respect to the cylinder head longitudinal axis and which is generally shorter than one of the two cylinder head longitudinal sides.

The exhaust-gas turbocharger is preferably arranged on that end side of the cylinder head at which the transmission, which is connected to the crankshaft which is mounted in the cylinder block, is situated. An arrangement of the exhaust-gas turbocharger above the transmission enables dense packaging of the drive unit. It is fundamentally also possible for the exhaust-gas turbocharger to be arranged above the cylinder head or below the cylinder block in order to form an internal combustion engine according to the invention.

Embodiments of the internal combustion engine are advantageous in which an oil supply to the exhaust-gas turbocharger is provided via the cylinder head. Here, a line 14 for supplying the exhaust-gas turbocharger with oil branches off from the oil line system of the cylinder head.

The oil serves to lubricate the bearing arrangement of the charger shaft, which bearing arrangement is generally embodied as a plain bearing, that is to say hydrodynamic bearing, also on account of the very high speeds.

In this connection—as already mentioned—embodiments are advantageous in which the charger is at least partially integrated in the cylinder head or cylinder block of the internal combustion engine, such that at least parts of the charger and of the cylinder head or cylinder block form a monolithic component.

In said embodiment, the line for supplying oil to the exhaust-gas turbocharger may be integrated in the cylinder head and the charger. An external line for supplying oil is avoided, and it is therefore not necessary to form and seal off connecting points between a line and the charger and between a line and the cylinder head. The oil may be extracted from the cylinder head and supplied to the charger without the risk of leakage. The integration of the line also leads to a reduction in the number of components, and to a more compact design.

A supply of oil to the exhaust-gas turbocharger may also take place via the cylinder block.

Embodiments of the internal combustion engine are advantageous in which the internal combustion engine is fitted with a coolant jacket which is at least partially integrated in the cylinder head.

The heat released during the combustion as a result of the exothermic chemical conversion of the fuel is dissipated partially to the cylinder head and the cylinder block via the walls which delimit the combustion chamber, and partially via the exhaust-gas flow to the adjoining components and to the environment. To limit the thermal loading of the cylinder head, a part of the heat flow which is introduced into the cylinder head must be extracted from the cylinder head again. It is fundamentally possible for the cooling to be provided in the form of air cooling or liquid cooling.

However, since significantly greater heat quantities can be dissipated by means of a liquid cooling arrangement and the cylinder head of the internal combustion engine according to the invention is thermally more highly loaded, as a result of the fully integrated exhaust manifolds, than a conventional cylinder head which is fitted with an external manifold, it is advantageous to use liquid cooling in a cylinder head of the present type, in particular if it is taken into consideration that the thermal loading in turbocharged engines is higher still, and the internal combustion engine according to the invention is a turbocharged internal combustion engine.

Liquid cooling requires the internal combustion engine or the cylinder head to be fitted with a coolant jacket 15*a* that is to say the arrangement of coolant ducts which conduct the coolant through the cylinder head.

Efficient cooling is necessary in turbocharged internal combustion engines with a fully integrated exhaust manifold. Here, embodiments are advantageous in which the coolant jacket has a lower coolant jacket which is arranged between the exhaust manifold and an assembly end side of the cylinder head at which the cylinder head can be connected to a cylinder block, and an upper coolant jacket which is arranged on that side of the exhaust manifold which is situated opposite the lower coolant jacket. At least one connection which serves for the passage of coolant is preferably provided between the lower coolant jacket and the upper coolant jacket.

In turbocharged internal combustion engines having a coolant jacket at least partially integrated in the cylinder head, embodiments of the internal combustion engine are advantageous in which the turbine, which has a turbine housing, is fitted with a coolant jacket 15*b* in order to form a liquid cooling arrangement, with the coolant jacket which is integrated in the cylinder head being connected to the coolant jacket of the turbine.

If the turbine is cooled not by air cooling, as in the prior art, but rather by liquid cooling, it is possible, on account of the significantly higher cooling capacity of a liquid cooling arrangement in relation to an air cooling arrangement, to entirely or at least partially dispense with the use of thermally more highly loadable materials for producing the turbine and the turbine housing. The use of expensive—often nickel-containing—materials is then no longer necessary, or is greatly reduced.

On account of the fact that, in the present case, the exhaust gas is already cooled as it flows through the turbine, it is possible, if exhaust gas is branched off from the exhaust line downstream of the turbine for the purpose of exhaust-gas recirculation, for a cooler which is provided for cooling the exhaust gas to be recirculated to be dimensioned to be smaller.

Embodiments are advantageous in which each cylinder has at least two outlet openings for discharging the exhaust gases out of the cylinder. During the discharging of the exhaust gases during the charge exchange, it is a primary aim to open up the greatest possible flow cross sections as quickly as possible in order to ensure an effective discharge of the exhaust gases, and therefore the provision of more than one outlet opening is advantageous.

Here, embodiments are advantageous in which firstly the exhaust lines of the at least two outlet openings of each cylinder merge to form a partial exhaust line associated with the cylinder, before the partial exhaust lines of at least two cylinders are merged to form the overall exhaust line.

Said configuration of the integrated system of exhaust lines shortens the overall path of all the exhaust lines. The stepped merging of the exhaust lines to form an overall exhaust line also contributes to a more compact, that is to say less voluminous, design of the cylinder head, and therefore in particular to a weight reduction and more effective packaging in the engine bay.

Embodiments of the internal combustion engine are advantageous in which no further assemblies are arranged upstream of the turbine.

Embodiments of the internal combustion engine are likewise advantageous in which no further assemblies are arranged downstream of the compressor.

The two above-stated embodiments have proven to be advantageous for maintaining the charge pressure up to the inlet into the cylinder and maintaining the exhaust-gas pressure up to the inlet into the turbine. The pressure loss downstream of the compressor and upstream of the turbine is limited.

Nevertheless, embodiments of the internal combustion engine may also be advantageous in which a charge-air cooler and/or a throttle element are/is provided downstream of the compressor, with the charge-air cooler increasing the density of the combustion air and thereby contributing to a better charge of the cylinder, and with it being possible for the throttle element to serve, for example, for load control.

Embodiments of the internal combustion engine are advantageous in which the turbine is a radial turbine. In radial turbines, the inflow to the rotor blades is aligned substantially radially. "Substantially radially" means that the speed component in the radial direction is greater than the axial speed component. The speed vector of the flow intersects the shaft or axle of the exhaust-gas turbocharger, specifically at right angles if the inflow is aligned exactly radially.

In order that the inflow to the rotor blades is aligned radially, the inlet region for supplying the exhaust gas may be designed as an encircling spiral housing or worm housing. With a radial turbine of said type, the inlet region of the radial turbine is preferably formed coaxially with respect to the overall exhaust line which opens out into the turbine; this offers flow-related advantages.

In the arrangement of the exhaust-gas turbocharger according to the invention, a radial turbine permits substantially rectilinear guidance of the overall exhaust line, with the overall exhaust line being provided with only one curve upstream of the turbine. Embodiments of the internal combustion engine in which the overall exhaust line has at most one curve upstream of the turbine, such that the exhaust-gas flow is subjected to at most one change in direction, ensure that the exhaust gas flow is supplied to the turbine with the lowest losses possible.

The turbine of the exhaust-gas turbocharger may also be designed as an axial turbine in which the inflow to the rotor blades is aligned substantially axially, with "substantially axially" meaning that the speed component in the axial direction is greater than the radial speed component. Here, the speed vector of the inflow in the region of the rotor preferably runs parallel to the shaft or axle of the exhaust-gas turbocharger if the inflow runs exactly axially.

The inlet region of an axial turbine may likewise be designed as an encircling spiral housing or worm housing, such that the flow of the exhaust gas runs or is conducted obliquely or radially with respect to the shaft at least in the inlet region.

The inflow to the rotor blades of an axial turbine may however also be aligned axially, with the inlet region preferably being formed coaxially with respect to the shaft of the axial turbine, such that the supply flow of the exhaust gas to the turbine is aligned substantially axially. Such a supply of the exhaust gas to the turbine prevents relatively high, that is to say noticeable, pressure losses in the exhaust-gas flow as a result of flow deflection, and therefore has the result that the exhaust gas which is provided to the turbine is as energy-rich as possible.

In contrast, the supply of the exhaust gas by means of a spiral or worm housing requires that the exhaust gas or the exhaust-gas flows be deflected multiple times with significant changes in direction, which results in a pressure loss in the exhaust-gas flow.

The use of an axial turbine leads to an improved response behavior of the internal combustion engine as a result of an improved acceleration of the rotor, in particular on account of the lower moment of inertia of the rotor of the turbine. The torque of the internal combustion engine at low rotational speeds is increased, since axial turbines have—in relation to radial turbines with the same throughflow capacity—an improved build-up behavior on account of their smaller effective flow cross section. The turbine pressure ratio of an axial turbine is therefore greater in said operating state.

If the internal combustion engine has three or more cylinders, embodiments of the internal combustion engine are advantageous in which the turbine is a multi-channel turbine in which the inlet region has a plurality of inlet ducts into which exhaust lines, which are combined in groups, of the at least three cylinders open out.

Multi-channel turbines make it possible for the exhaust lines of the cylinders to be merged in groups, and for said exhaust lines, which are combined in groups, to be conducted separately from one another to the turbine. Here, the exhaust lines are preferably combined, that is to say merged, in such a way that the dynamic wave phenomena in the exhaust lines do not attenuate one another. For this purpose, the internal combustion engine preferably has four or more cylinders. A multi-channel turbine is suitable for impulse turbocharging, with which high turbine pressure ratios can be attained even at low rotational speeds.

Embodiments of the internal combustion engine may be advantageous in which guide blades for manipulating the flow direction are arranged in the inlet region. In contrast to the rotor blades of the rotating rotor, the guide blades do not rotate with the shaft of the turbine. If the turbine has a fixed, invariable geometry, the guide blades are arranged so as to be not only stationary but rather also completely immovable, that is to say rigidly fixed, in the inlet region. In contrast, if use is made of a turbine with a variable geometry, the guide blades are duly also arranged so as to be stationary, but not so as to be completely immovable, rather so as to be rotatable about their axis, such that the inflow to the rotor blades can be manipulated.

Embodiments of the internal combustion engine are advantageous in which at least one exhaust-gas aftertreatment system is arranged downstream of the turbine.

Embodiments of the internal combustion engine are advantageous in which the compressor is an axial compressor. In compressors, in contrast to turbines, it is the direction of the outflow out of the rotor blades which is referred to. In an axial compressor, the outflow is therefore aligned substantially axially. Here, the speed vector of the outflow in the region of the rotor runs parallel to the shaft or axle of the exhaust-gas turbocharger. In contrast, the inflow may be aligned radially.

It is however fundamentally also possible to use a radial compressor, which offers advantages with regard to the arrangement of the charger according to the invention, since the number of curves in the intake downstream of the compressor can be reduced when using a radial compressor.

Embodiments of the internal combustion engine are advantageous in which a recirculation line for recirculating exhaust gas is provided, which recirculation line 16*a* branches off from the overall exhaust line upstream of the turbine and opens out into the intake downstream of the compressor. In said so-called high-pressure EGR arrangement, exhaust gas is extracted from the overall exhaust line upstream of the turbine, such that the exhaust gas to be recirculated flows neither through the turbine on the outlet side nor through the compressor on the inlet side, and therefore the compressor also cannot be contaminated with exhaust-gas constituents.

Embodiments of the internal combustion engine are however also advantageous in which a recirculation line for recirculating exhaust gas is provided, which recirculation line 16*b* branches off from the overall exhaust line downstream of the turbine and opens out into the intake upstream of the compressor.

In said so-called low-pressure EGR arrangement, exhaust gas is extracted from the overall exhaust line downstream of the turbine, such that the exhaust gas to be recirculated flows through the turbine on the outlet side and contributes to the turbocharging of the internal combustion engine. The exhaust gas to be recirculated is conducted into the intake upstream of the compressor, and subsequently flows through the compressor, which is advantageous in particular with high recirculation rates, or high recirculated exhaust-gas quantities, in order to adequately mix the recirculated exhaust gas with the fresh intake air, that is to say in order to homogenize the combustion air which is supplied to the cylinders.

An internal combustion engine according to the invention may have both a high-pressure EGR arrangement and also a low-pressure EGR arrangement at the same time.

Embodiments of the internal combustion engine are advantageous in which a cooler is provided in the recirculation line for exhaust-gas recirculation. Said cooler reduces the temperature in the hot exhaust-gas flow and thereby increases the density of the exhaust gases, as a result of which high exhaust-gas quantities can be recirculated. The temperature of the fresh charge which is set in the intake when the fresh air is mixed with the recirculated exhaust gas is reduced, as a result of which the additional cooler also contributes to an improved charge of the combustion chamber.

To realize high recirculation rates, cooling of the exhaust gas to be recirculated, that is to say a compression of the exhaust gas by cooling, may be imperatively necessary. The density of the recirculated exhaust gas increases as a result of the cooling.

DETAILED DESCRIPTION

Figure 1:
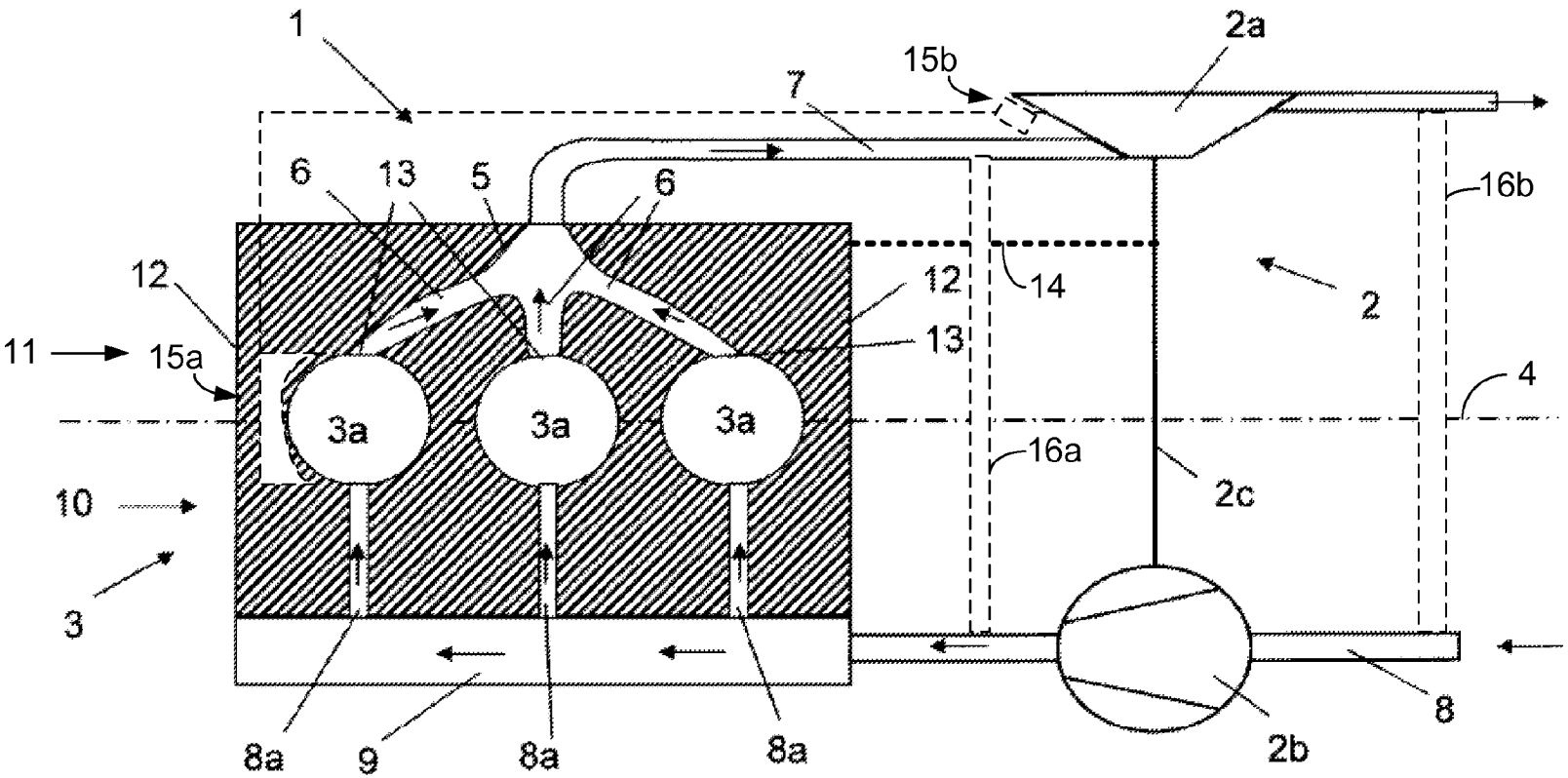
FIG. 1 schematically shows a first embodiment of the internal combustion engine.
Figure 2:
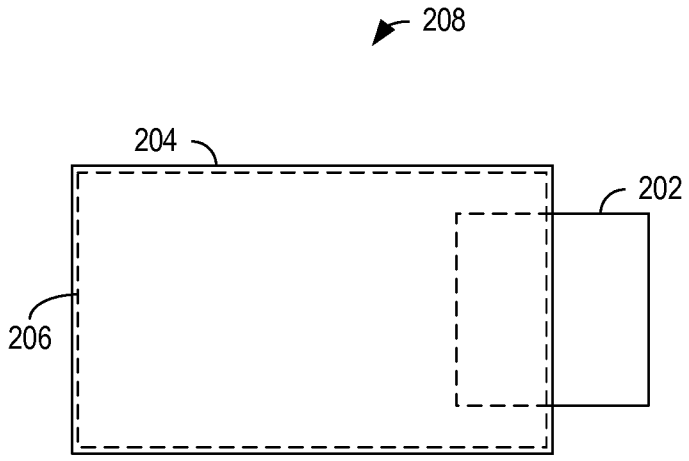
FIG. 2 schematically shows a turbocharger at least partially integrated in a cylinder head or cylinder block of an internal combustion engine in accordance with one or more embodiments of the present disclosure.

FIG. 1 shows a first embodiment of the turbocharged internal combustion engine 1 on the basis of the example of a three-cylinder engine.

The internal combustion engine 1 has a cylinder head 3 with three cylinders 3*a* which are arranged along the cylinder head longitudinal axis 4 and each of which has an outlet opening 13 adjoined by an exhaust line 6 for discharging the exhaust gases out of the cylinder 3*a*. The exhaust lines 6 of the three cylinders 3*a* are merged on the outlet side 11, so as to form an integrated exhaust manifold 5 within the cylinder head 3, to form an overall exhaust line 7.

To supply the internal combustion engine 1 with fresh air or fresh mixture, an intake 8 is provided on the inlet side 10, which intake 8 opens out into a plenum 9 from where three intakes 8*a* provide a supply to the cylinders 3*a*.

The internal combustion engine 1 is fitted with an exhaust-gas turbocharger 2 which comprises a turbine 2*a*, which is arranged in the overall exhaust line 7, and a compressor 2*b*, which is arranged in the intake 8, with no further assemblies being arranged either downstream of the compressor 2*b* in the intake 8 or upstream of the turbine 2*a* in the overall exhaust line 7.

The exhaust-gas turbocharger 2 is arranged laterally on one of the two end sides 12 of the cylinder head 3, specifically in such a way that the charger shaft 2*c* runs transversely—in the present case perpendicularly—with respect to the cylinder head longitudinal axis 4—with the turbine 2*a* being arranged on the outlet side 11 and the compressor 2*b* being arranged on the inlet side 10, corresponding to their respective functions.

The overall exhaust line 7 runs predominantly perpendicularly with respect to the charger shaft 2*c* and has only one curve upstream of the turbine 2*a*, such that the exhaust-gas flow is subjected to only one change in direction. This ensures that the exhaust gas is supplied to the turbine 2*a* with the lowest losses possible. The central axis of the inlet region of the turbine 2*a* for the supply of the exhaust gas is aligned with the overall exhaust line 7.

It will be appreciated that the configurations disclosed herein are exemplary in nature, and that these specific embodiments are not to be considered in a limiting sense, because numerous variations are possible. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

Such claims, whether broader, narrower, equal, or different in scope to the original claims, also are regarded as included within the subject matter of the present disclosure.

The invention claimed is:

1. A turbocharged internal combustion engine having:

at least one intake for supplying the internal combustion engine with fresh air mixture on an inlet side, a cylinder head having at least two cylinders which are arranged along a cylinder head longitudinal axis and each of which has at least one outlet opening which is adjoined by an exhaust line for discharging exhaust gases out of at least one of the at least two cylinders, with the exhaust lines of at least two cylinders being merged on an outlet side, so as to form an integrated exhaust manifold within the cylinder head, to form an overall exhaust line, and at least one exhaust-gas turbocharger which comprises a turbine arranged in the overall exhaust line and a compressor arranged in the at least one intake, with the turbine having a turbine rotor, which is provided on a charger shaft, and an inlet region for supplying the exhaust gas, and the compressor having a compressor rotor, which is arranged on the charger shaft, and an outlet region for discharging compressed combustion air from the compressor to a plenum, wherein the at least one exhaust-gas turbocharger is arranged in such a way that the charger shaft runs transversely with respect to the cylinder head longitudinal axis, with the turbine being arranged on the outlet side and the compressor being arranged on the inlet side with respect to the cylinder head longitudinal axis, the at least one exhaust-gas turbocharger being at least partially integrated in the cylinder head or a cylinder block of the turbocharged internal combustion engine, and the at least one intake does not curve between the compressor and the plenum.

2. The turbocharged internal combustion engine as claimed in claim 1, wherein a recirculation line for recirculating exhaust gas is provided, which recirculation line branches off from the overall exhaust line upstream of the turbine and opens out into the at least one intake downstream of the compressor.

3. The turbocharged internal combustion engine as claimed in claim 1, wherein a recirculation line for recirculating exhaust gas is provided, which recirculation line branches off from the overall exhaust line downstream of the turbine and opens out into the at least one intake upstream of the compressor.

4. The turbocharged internal combustion engine as claimed in claim 1, wherein an outlet of the compressor extends from the compressor to the plenum in a direction that is parallel to the cylinder head longitudinal axis.

5. The turbocharged internal combustion engine as claimed in claim 1, wherein the compressor directs air flow in a longitudinal direction with respect to the at least two cylinders directly into the plenum.

6. The turbocharged internal combustion engine as claimed in claim 1, wherein the charger shaft runs perpendicularly with respect to the cylinder head longitudinal axis.

7. The turbocharged internal combustion engine as claimed in claim 6, wherein the at least one exhaust-gas turbocharger is arranged laterally on an end side of the cylinder head.

8. The turbocharged internal combustion engine as claimed in claim 7, wherein an oil supply to the at least one exhaust-gas turbocharger is provided via the cylinder head.

9. The turbocharged internal combustion engine as claimed in claim 8, wherein a line for the oil supply to the exhaust-gas turbocharger is integrated in the cylinder head and the exhaust-gas turbocharger.

10. The turbocharged internal combustion engine as claimed in claim 8 having a coolant jacket which is at least partially integrated in the cylinder head, wherein the turbine, which has a turbine housing, is fitted with a coolant jacket in order to form a liquid cooling arrangement, with the coolant jacket which is integrated in the cylinder head being connected to the coolant jacket of the turbine.

11. The turbocharged internal combustion engine as claimed in claim 10, wherein no further assemblies are arranged upstream of the turbine.

12. The turbocharged internal combustion engine as claimed in claim 11, wherein no further assemblies are arranged downstream of the compressor.

13. The turbocharged internal combustion engine as claimed in claim 12, wherein the turbine is a radial turbine.

14. The turbocharged internal combustion engine as claimed in claim 13, wherein the compressor is an axial compressor.

15. A turbocharged internal combustion engine, comprising:

an air intake line, a cylinder head having at least two cylinders arranged along a longitudinal axis of the cylinder head, each cylinder having at least one outlet opening adjoined by an exhaust line for discharging exhaust gases, the exhaust lines merged on an outlet side, to form an integrated exhaust manifold within the cylinder head coupled to an exhaust line; and an exhaust-gas turbocharger having a charger shaft running transversely to the cylinder head longitudinal axis, the turbocharger being at least partially integrated into the cylinder head such that at least a portion of each of the turbocharger and the cylinder head form a monolithic component, comprising:

a turbine arranged in the exhaust line, the turbine having a turbine rotor coupled on the charger shaft, and an inlet region for supplying exhaust gas; and a compressor arranged in the intake line, the compressor having a compressor rotor coupled on the charger shaft, and an outlet region for discharging compressed combustion air from the compressor directly to a plenum without changing a direction of the compressed combustion air, the charger shaft intersecting a plane which runs through the cylinder head longitudinal axis such that the turbine is situated on the outlet side of the cylinder head and the compressor is situated entirely on an inlet side of the cylinder head, the outlet side and the inlet side being separated by the cylinder head longitudinal axis.

16. The turbocharged internal combustion engine as claimed in claim 15, wherein an outlet of the compressor extends from the compressor to the plenum in a direction that is parallel to the cylinder head longitudinal axis.

17. The turbocharged internal combustion engine as claimed in claim 15, wherein the compressor directs air flow in a longitudinal direction with respect to the at least two cylinders directly into the plenum.

* * * * *